United States Patent [19]

Rensch

[11] 4,107,893

[45] Aug. 22, 1978

[54] PREFABRICATED BUILDING STRUCTURE

[76] Inventor: Eberhard G. Rensch, Lerchesbergring 24, Frankfurt, Main, Fed. Rep. of Germany, 6000

[21] Appl. No.: 673,134

[22] Filed: Apr. 2, 1976

Related U.S. Application Data

[63] Continuation-in-part of Ser. No. 562,802, Mar. 27, 1975, abandoned, which is a continuation of Ser. No. 357,838, May 7, 1973, abandoned.

[30] Foreign Application Priority Data

| | | | |
|---|---|---|---|
| Sep. 4, 1975 | [DE] | Fed. Rep. of Germany | 7528031[U] |
| Jan. 8, 1976 | [DE] | Fed. Rep. of Germany | 2600547 |
| May 13, 1972 | [DE] | Fed. Rep. of Germany | 2223457 |
| Jun. 19, 1972 | [DE] | Fed. Rep. of Germany | 2229737 |

[51] Int. Cl.[2] ..... E06B 3/04

[52] U.S. Cl. ..... 52/775

[58] Field of Search ..... 52/397, 398, 399, 400, 52/499, 500, 501

[56] References Cited

U.S. PATENT DOCUMENTS

| | | | |
|---|---|---|---|
| 1,241,635 | 10/1917 | Klein | 52/238 |
| 1,301,896 | 4/1919 | Baxter | 52/499 |
| 2,402,105 | 6/1946 | Verhagen | 49/1 |
| 2,914,145 | 11/1959 | Benson | 52/235 |
| 3,092,216 | 6/1963 | Young | 52/501 |
| 3,093,217 | 6/1963 | Doede | 49/1 |
| 3,169,281 | 2/1965 | Clements | 52/498 |
| 3,436,885 | 4/1969 | Rothermel | 52/476 |
| 3,490,178 | 1/1970 | Voisin | 52/498 |
| 3,749,432 | 7/1973 | Janssen | 52/476 |

FOREIGN PATENT DOCUMENTS

| | | | |
|---|---|---|---|
| 1,208,335 | 6/1958 | France | 52/235 |

*Primary Examiner*—John E. Murtagh
*Attorney, Agent, or Firm*—Karl F. Ross

[57] ABSTRACT

A structural framework for a building, to be assembled from prefabricated parts, comprises a skeleton of columns and struts supporting wall elements which are framed by upper and lower struts and by columns spanned by these struts. Both the struts and the columns have faces formed with longitudinal slots receiving coplanar strips of rubber or other preferably thermally insulating material which project into the opening bounded thereby and coact with retainers on the columns and/or struts for holding the wall elements in position. Especially with wall elements in the form of windows, the retainers may be fixed sills set back from the slots of opposite strut or column faces. In other instances, the retainers may comprise brackets slidably engaging in the strut and/or columm slots and anchor lugs on the wall elements engageable with these brackets.

14 Claims, 13 Drawing Figures

PREFABRICATED BUILDING STRUCTURE

CROSS-REFERENCE TO RELATED APPLICATIONS

This application is a continuation-in-part of my copending and now abandoned application Ser. No. 562,802, filed Mar. 27, 1975 as a continuation of an earlier and now abandoned application, Ser. No. 357,838 filed May 7, 1973.

FIELD OF THE INVENTION

My present invention relates to a building structure composed of prefabricated modular units.

BACKGROUND OF THE INVENTION

It is known to construct the framework of a building from rigidly interconnected elongate vertical and horizontal modular units, referred to hereinafter as columns and struts, which form a skeleton with wall openings designed to receive a variety of wall elements including solid walls, windows and doors. Different mountings, varying with the type of wall elements, are used to secure the latter to the skeletal framework. Thus, solid walls generally require a permanent connection whereas window panes, for example, should be removably installed to facilitate their replacement in the event of damage. Internal partitions, finally, ought to have semipermanent joints to enable an occasional rearrangement of the rooms.

OBJECTS OF THE INVENTION

The general object of my present invention is to provide, in a building structure of the type herein referred to, simple means for attaching the various kinds of wall elements to the modular units of the framework without requiring the use of complicated equipment or skilled help.

Particularly in the case of doors, windows and outside walls exposed to the weather, as distinct from internal partitions, the joints between the wall elements and the framework should be so designed as to minimize heat transfer between the interior and the exterior of the building, for the purpose of energy conservation. An ancillary object of my invention, therefore, is to provide mounting means satisfying this requirement. It is also an object of this invention to provide semipermanent mounting means forming a firm but releasable connection between a modular unit and a wall element.

SUMMARY OF THE INVENTION

The basic modular units of my improved structure, i.e. its columns and struts, have vertical and horizontal faces provided with slots which extend over their full length, these slots being coplanar on a pair of parallel vertical column faces and on a pair of confronting horizontal strut faces which bound a common wall opening. A four-sided wall element occupying that opening rests against a set of mounting strips which are projectingly seated in the slots, the wall element being held in position adjacent the strips by retaining means disposed on at least one of these faces. The struts may be suitably profiled beams or grooved rail profiles carried on such beams or (especially in the case of a lower strut) on a base plate which in turn may rest on beams or be part of a foundation.

In an advantageous embodiment, the columns are prismatic profiles of substantially uniform wall thickness, the slots being formed by inbent wall portions of these profiles. For the minimization of heat transfer as discussed above, especially in the case of metallic columns, the column profiles can be split along the slots so as not to create any thermal bridges for the conduction of heat past the corresponding mounting strips; the latter than advantageously consist of a heat-insulating material, preferably hard rubber.

In certain instances, e.g. where the wall element is a window, the retaining means may be a sill or other fixed stop on at least one of the slotted faces, preferably a pair of such stops on opposite sides of the wall opening. The wall element can then be simply placed against these stops and locked in position by the strips subsequently inserted into their slots; if removal should be necessary, the strips (normally located inside the building) can be readily withdrawn and reinserted.

To establish a semipermanent connection between a column and an adjoining wall element, e.g. an internal partition, a retainer according to my invention may comprise a pair of coacting latch members on an edge surface of the wall element and on an adjoining column or strut face. The first latch member may be a lug fixedly secured to the wall element while the second latch member may be a bracket longitudinally slidable on the column or strut face, the bracket engaging in the slot of that face alongside the mounting strip inserted into same. The two latch members may have complementary wedge shapes enabling their frictional interfitting upon the sliding of the bracket into engagement with the lug.

BRIEF DESCRIPTION OF THE DRAWING

The above and other features of my invention will now be described in detail with reference to the accompanying drawing in which.

SPECIFIC DESCRIPTION

Figure 1:
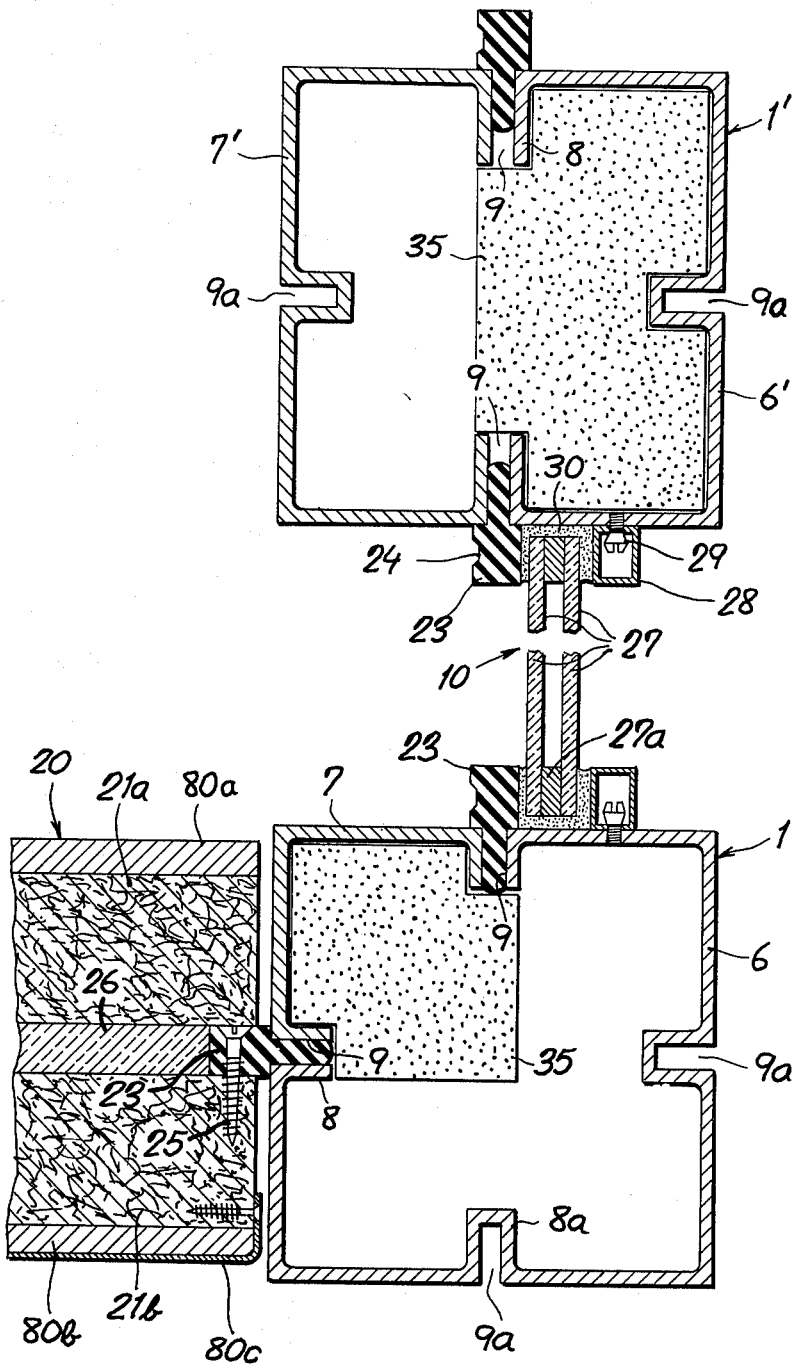
FIG. 1 is a cross-sectional top view of two spaced-apart columns forming part of a building structure according to my invention, together with adjoining wall elements.

In FIG. 1 I have shown part of a frame structure for a building, including a corner column 1 and a similar intermediate column 1' flanking a wall element 10. Another wall element 20 extends from corner column 1 toward a nonillustrated further column. The several columns are interconnected by upper and lower horizontal struts, not shown in this Figure, as more fully described hereinafter.

Columns 1 and 1' are hollow prismatic bodies of square cross-section with metallic walls of constant thickness. Each of the four column faces is provided with a longitudinal median slot 9 or 9*a* extending over the entire length thereof, these slots being formed by inbent wall portions of the column profile. In the case of slots 9 the inbent wall portions are parallel flanges 8 which are separated from each other, the slots being thus open toward the interior of the column. Slots 9*a* are defined by re-entrant wall portions 8*a* and can thus also be regarded as deep grooves. Because of the two throughgoing slots 9, the body of each column 1 and 1' is composed of two spaced-apart angular profiles 6 and 7 or 6' and 7'. Profile 6 of corner column 1 extends over substantially three-fourths of the prism circumference, profile 7 occupying the remaining quarter; profiles 6' and 7' of intermediate column 1' are substantially complementary halves.

Seated in each slot 9 is a mounting strip 23 of generally T-shaped cross-section, the head of the T projecting into the space between the columns while its stem or web is received in the slot. Strips 23 consist of hard rubber and, by virtue of their poor thermal conductivity, minimize the heat transfer across the edges of the external wall elements 10 and 20; the interruption of the metallic column bodies at the slots 9 further enhances this thermal insulation. For the same purpose, thermally insulating material 35 is shown inserted between strips 23 in columns 1 and 1'. Longitudinal flutes 24 in the projecting parts of strips 23 facilitate the attachment of the strips to associated wall elements by means of countersunk screws or other fasteners, as particularly illustrated for the wall element 20. The latter comprises a pair of panels 21*a* and 21*b* which sandwich the associated strips 23 (only one shown) between them and are rigidly interconnected by bolts or other means not shown, the panel 21*b* being engaged by a number of wood screws 25 passing through the corresponding strip 23. The gap between panels 21*a* and 21*b* is occupied by a heat-insulating filler 26, e.g. granules of synthetic resin. The panels are externally covered by face plates 80*a* and 80*b*, the outer plate 80*b* being overlain by a sheet-metal layer 80*c*.

Wall element 10 is a window with two glass panes 27 separated by a spacer frame 27*a*; the assembly is clamped between strips 23 and fixed sills 28 on the vertical column faces, the sills consisting of bars fastened to the columns by screws 29. A mass of putty 30 surrounds the peripheral edges of the window to hold it firmly in position and to prevent drafts, yet to allow removal of the panes (after extraction of the strips 23 from their slots 9) for purposes of replacement.

Figure 2:
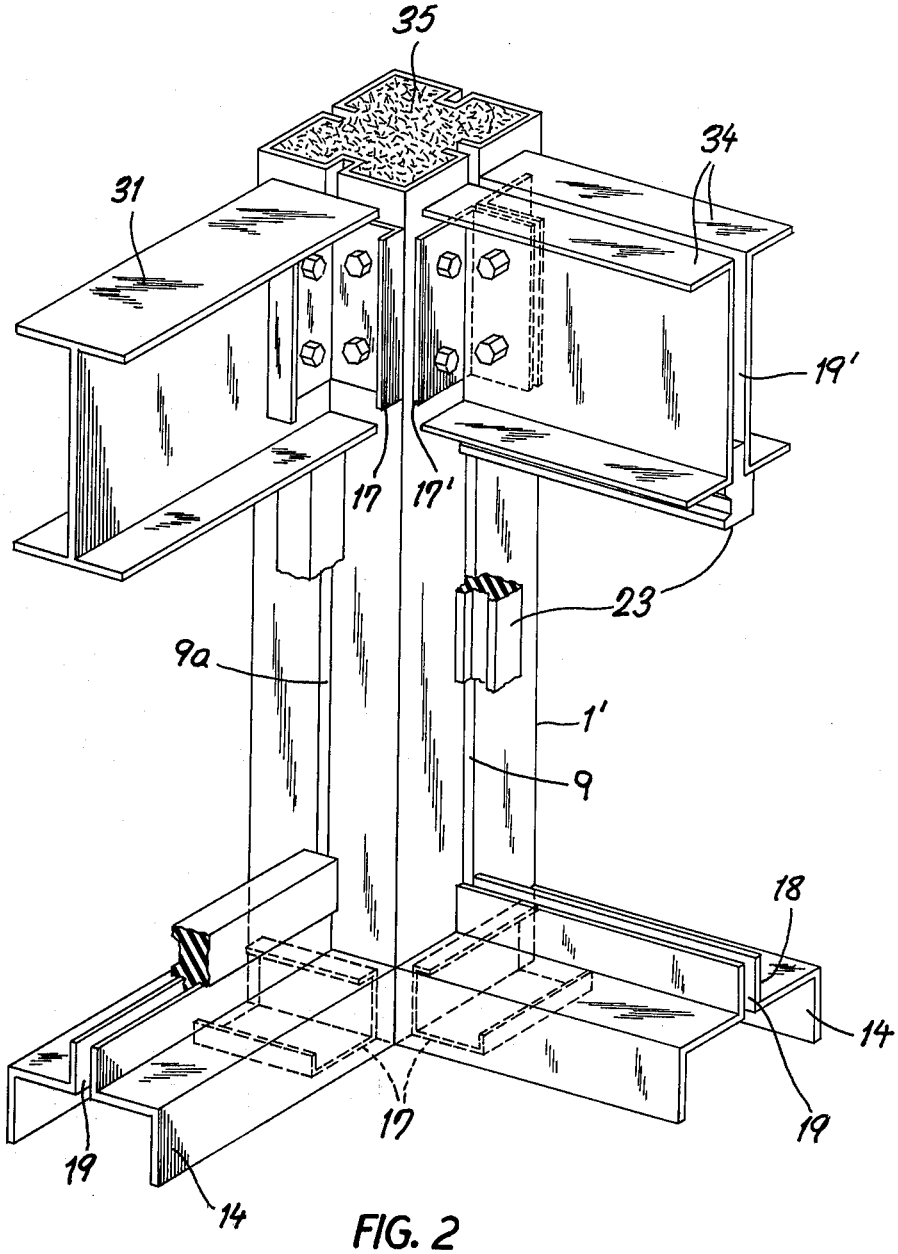
FIG. 2 is an isometric view of part of a framework included in a structure according to my invention, with a column rigidly supporting two pairs of beams.

In FIG. 2 I have shown part of a framework including a column 1' (split into two symmetrical sections, as in FIG. 1) with upper and lower beams extending from two or more faces thereof to nonillustrated further columns. Column 1' is here shown completely filled with insulation 35. The two lower beams 14 are identical and consist each of two symmetrical halves having closely spaced parallel flanges 18 which define between them a horizontal slot 19 coplanar with a vertical slot 9 or 9*a* of column 1'. Mounting strips 23 are inserted in all the slots 9, 9*a* and 19 as well as in a similar horizontal slot 19' defined by the spaced-apart symmetrical halves of a split upper I-beam 34, slot 19' opening into the slot 9 of the column. The other upper beam 31 has a unitary I-profile whose lower flange can be fitted with a profiled rail 70, as illustrated in FIG. 4, to accommodate an upper mounting strip in a slot 72 of that rail (see also FIG. 3). Beams 14 and 31 are secured to column 1' with the aid of flanged angle profiles 17 bolted, riveted or otherwise fastened thereto; two simple angle profiles 17', with legs extending into the slot 19', serve to secure the split beam 34 to the column. The beam ends remote from column 1 are, of course, similarly secured to further columns not shown. The confronting faces of beams 14 and 34, bounding the slots 19 and 19', are in line with the inbent wall portions of column 1' defining the slot 9.

Upper beam 34 and the corresponding lower beam 14, which may be duplicated on the opposite side of column 1', serve to support an external wall element, such as the window 10 of FIG. 1, with the aid of their mounting strips 23 and non-illustrated backstops such as the sills 28 described above. An internal wall element, not shown, fits between the other lower beam 14 and the corresponding upper beam 31.

Figure 3:
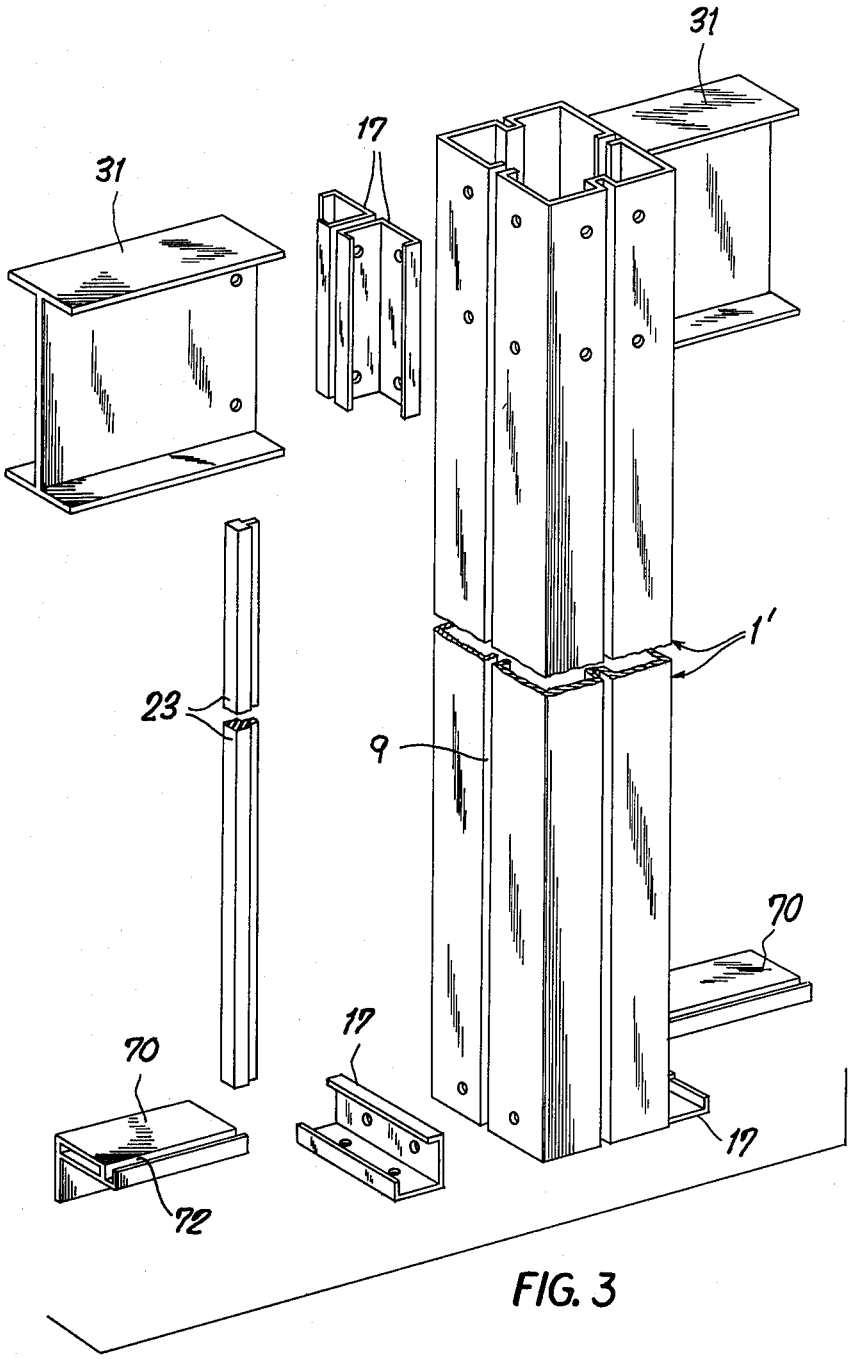
FIG. 3 is an exploded isometric view of a beam-and-column assembly similar to that shown in FIG. 2.
Figure 4:
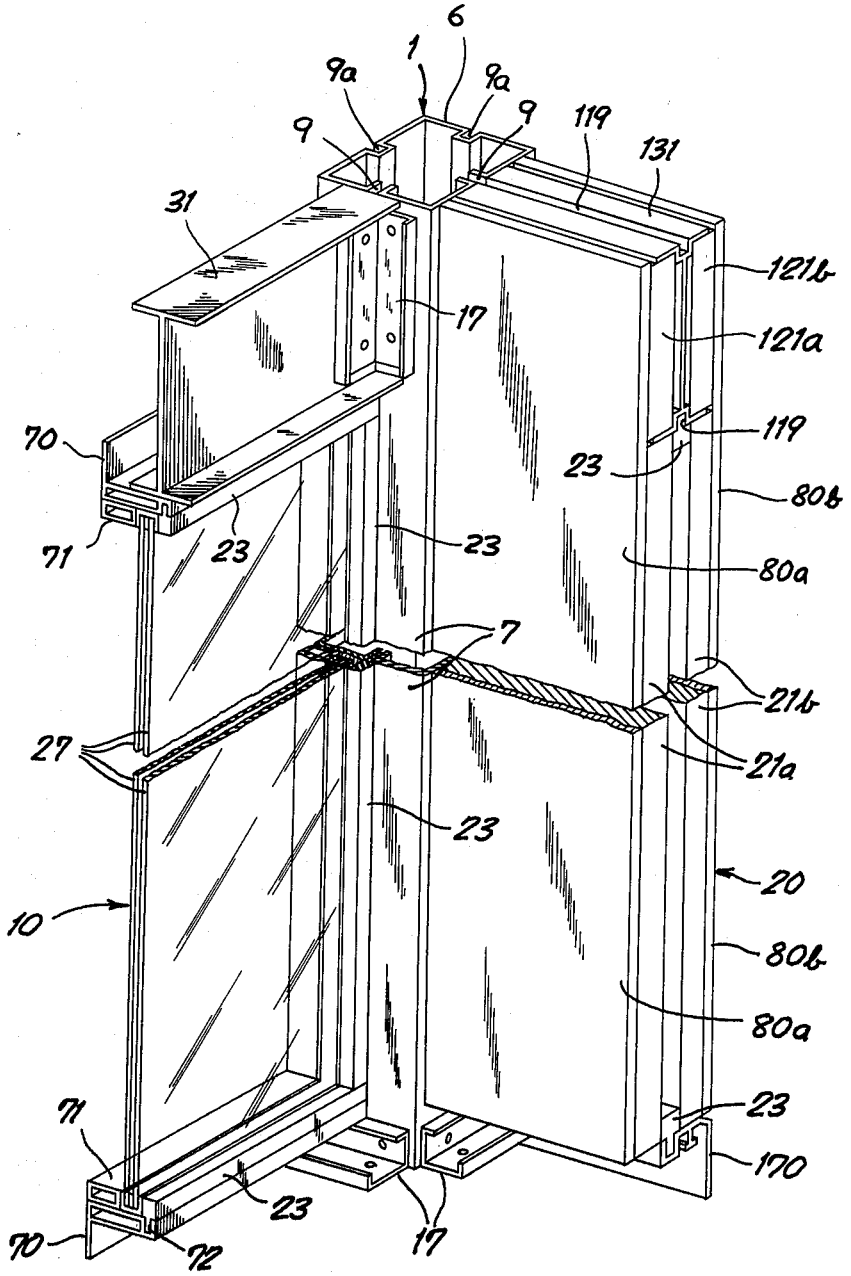
FIG. 4 is an isometric view of a corner of a building assembled from components of the type shown in FIG. 3 together with associated wall elements.
Figure 5:
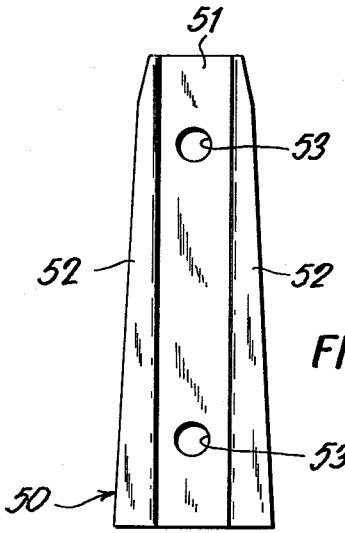
FIG. 5 is a face view of a retaining lug to be used in an assembly of a column and a wall element similar to that shown in FIG. 4.
Figure 6:
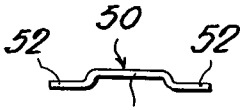
FIG. 6 is a top view of the lug shown in FIG. 5.
Figure 7:
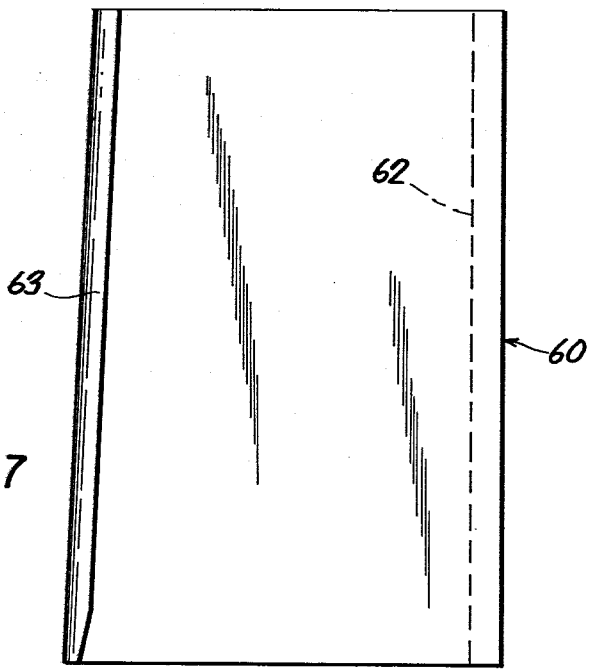
FIG. 7 is a face view of a retaining bracket designed to co-operate with the lug of FIGS. 5 and 6.
Figure 8:
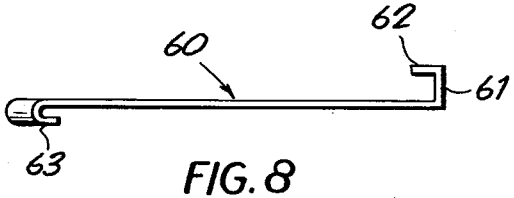
FIG. 8 is a top view of the bracket shown in FIG. 7.

FIG. 3 shows further details of certain components illustrated in FIG. 2, i.e. column 1', profiles 17, a strip 23, beams 31 and rails 70, in a disassembled state.

Figure 10:
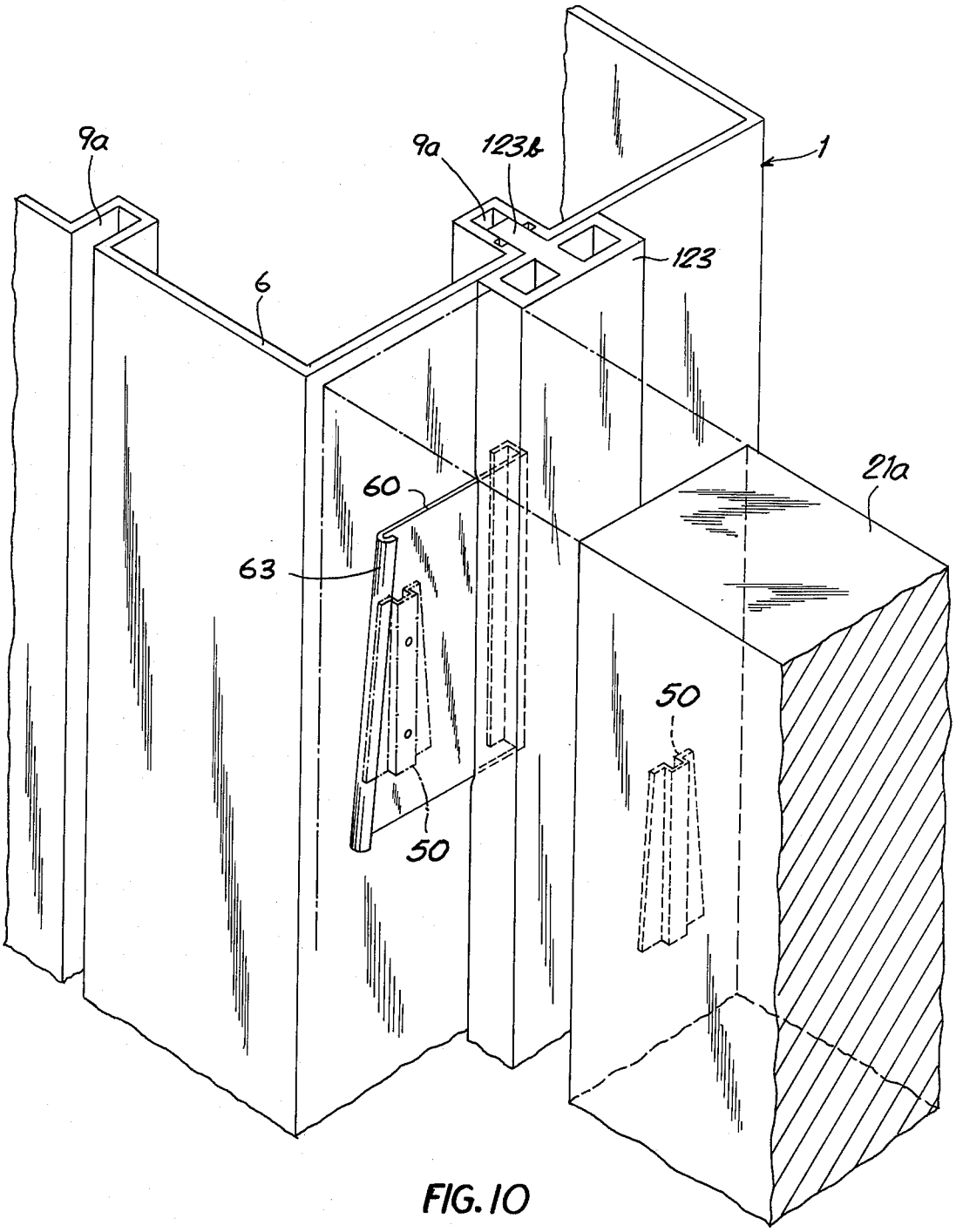
FIG. 10 is a fragmentary isometric view of the column of FIG. 9 and an adjoining wall element to be fastened thereto.
Figure 11:
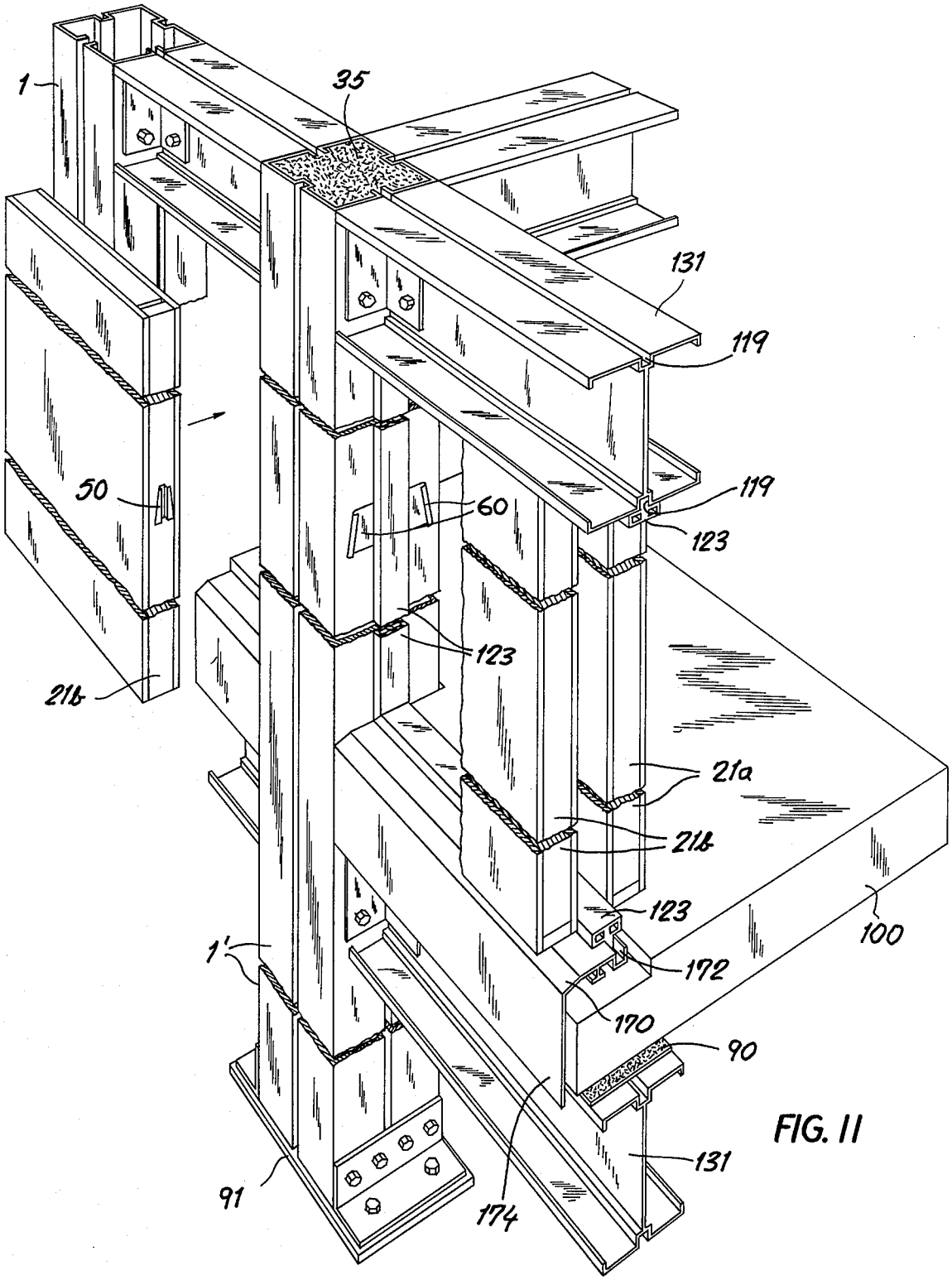
FIG. 11 is an isometric view of a more complete assembly including the structure of FIG. 10.

In FIG. 4 I have illustrated a corner of a building structure according to my invention including a column 1 with two throughgoing slots 9 and two deep grooves 9*a* (here unused), the slots 9 accommodating vertical mounting strips 23 which help retain two wall elements 10 and 20 in respective openings of a framework comprising the column 1, upper struts 31 and 131, lower struts 70 and 170 resting on profiles 17 which are fastened to the foot of that column, and nonillustrated further columns secured to these struts to define therewith rectangular wall openings occupied by components 10 and 20. The upper and lower flanges of beam 131, which has a unitary I-profile, are formed with median grooves or slots 119 coplanar with one of the column slots 9, the lower slot 119 holding a mounting strip 23; a similar strip in its upper slot may form part of a wall mounting for the next-higher story. Rails 70 carry bars 71 which lie parallel to strips 23, received in slots 72 thereof, to form backstops for the window panes 27. The panels 21*a* and 21*b* of wall 20 can be secured to their vertical mounting strips on column 1 and on a nonillustrated second column in the manner shown in FIG. 1, i.e. with the aid of screws 25, or by means of coacting latch members as described hereinafter with reference to FIGS. 5 – 11. Panel 21*a* and lower rails 70 and 170 may be supported by a stepped floor plate, as illustrated in FIG. 11, resting on beams or on an underlying foundation.

Detached extensions 121*a* and 121*b* of panels 21*a* and 21*b* are disposed between face plates 80*a* and 80*b* on opposite sides of the web of the upper beam 131. A thermally insulating mass, as shown at 26 in FIG. 1, may again be inserted between the panels as well as between their extensions.

In FIGS. 5 – 8 I have shown a pair of coacting latch members, i.e. a retaining lug 50 and an associated bracket 60, by which a wall element such as a pair of panels 21*a*, 21*b* can be firmly yet releasably secured to a modular unit framing a wall opening, such as a column 1 or 1', a beam 31, 131 or 34, or a rail 70 or 170. Lug 50 comprises a channel profile 51 with upwardly narrowing lateral wings 52 and with holes 53 for the passage of mounting screws by which it can be fixedly secured to a vertical edge surface of a panel 21*a* or 21*b* as shown in FIGS. 10 and 11. The coacting bracket 60 is of generally Z-shaped profile and has on one side a flange 61 with a bent-over lip 62, its opposite side being rolled into a bead 63 converging upwardly toward the flange 61.

Figure 9:
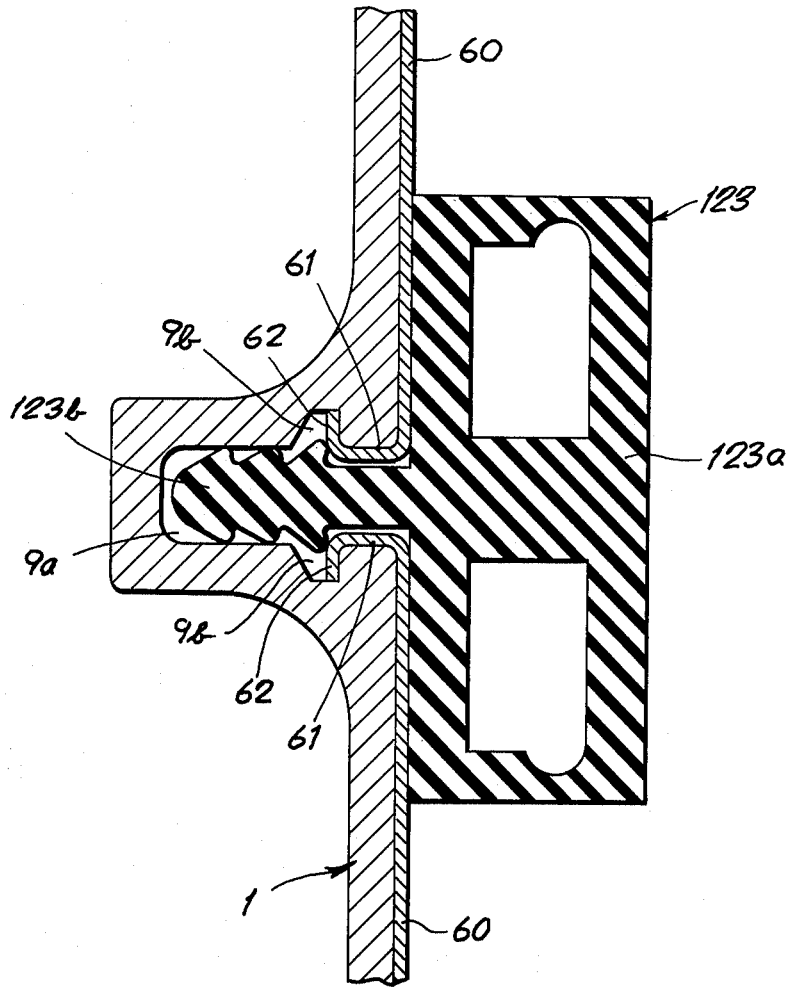
FIG. 9 is a fragmentary cross-sectional view, drawn to a larger scale, of a column according to my invention together with a mounting strip and a pair of retaining brackets as shown in FIGS. 7 and 8.

In FIG. 9 a slot 9*a* of a column 1 is shown provided with two longitudinal undercuts 9*b* each adapted to receive the lip 62 of a respective bracket 60 whose flange 61 enters that slot on one or the other side of the web 123*b* of a mounting strip 123, the enlarged portion 123*a* of that strip exerting a certain clamping pressure upon the two brackets 60 which are positively gripped from behind by serrations of web 123*b*. The brackets 60, whose height somewhat exceeds that of the associated lugs 50, are thus vertically slidable independently of each other along the face of the column on opposite sides of strip 123 against frictional resistance only. They are initially positioned at the very top of the column and the strip, above the level of lugs 50, while the panels 21*a* and 21*b* are spaced from the column as illustrated schematically in FIGS. 10 and 11. After these panels have been aligned with the column, the brackets 60 are lowered with the aid of a suitable tool such as a blade introduced into the narrow gap remaining between each panel and the column. As the bead 63 of the descending bracket grips the downwardly diverging outer flange 52 of the lug 50 affixed to the panel, the latter is cammingly pressed against the strip 123 and is firmly locked to the column 1 or 1'. Air circulation and heat transfer through the joint is effectively prevented by the insulating strip 123, despite the presence of the aforementioned narrow gaps which of course may be covered up by wallpaper, weather stripping and the like.

FIG. 11 shows a bottom or base plate 100 resting on lower beams 131, with interposition of a thermally insulating layer 90. A column 1', rising from a pedestal 91 on a foundation not further illustrated, is rigidly connected with these lower and identical upper beams 131, the upper beams carrying strips 123 in their lower slots 119 to serve as abutments for panels 21*a*, 21*b* which are to be emplaced on plate 100 and rails 170 adjacent the column 1' preparatorily to interengagement of latch members 50 and 60 as described above. A similar strip 123 is also received in a groove 172 of each rail 170 which has an apron 174 overhanging the bottom plate 100. The interior of the hollow column 1' may again be filled with a heat-insulating mass 35.

The separated sections of any longitudinally split column may be held together by its pedestal, a header at the top, bolts, bands, and the like. Polygonal cross-sections other than squares may be used as described in my prior applications identified above.

Although only one pair of connectors 50, 60 has been shown at a joint between a column and a wall element, it will be apparent that several such connector pairs may be provided at different levels for more firmly uniting these components with each other. Similar connectors may, of course, be provided on more than one side of the frame structure surrounding a wall element, thus between panels 21*a*, 21*b* (FIG. 11) and upper beam 131, rail 170 and/or plate 100, as well as between these panels and the column bounding the fourth side of each wall opening, one such further column 1 being also seen in FIG. 11. In some instances the bent-over lips 62 of bracket 60 may be omitted (e.g. where the bracket slides horizontally on an upper strut face), the bracket then being guided only by its flange 61.

Naturally, one of the panels (e.g. the outer panel 21*b*) of a wall element 20 may be secured to the associated mounting strips 23 by screws or the like, in the manner illustrated in FIG. 1, the other panel being then fastened with latch joints 50, 60 to the columns and struts framing its wall opening.

Although only a one-story structure has been illustrated and described in detail, it will be apparent that the same construction may be duplicated on different floors of a multistory building in which the columns are extended upwardly to support additional beams at higher levels.

Split beams 34, as shown in FIG. 2, may be used in lieu of unitary metallic beams wherever thermal insulation is required. Rails 70, 170 and other profiles may consist of thermally insulating material instead of metal.

Figure 12:
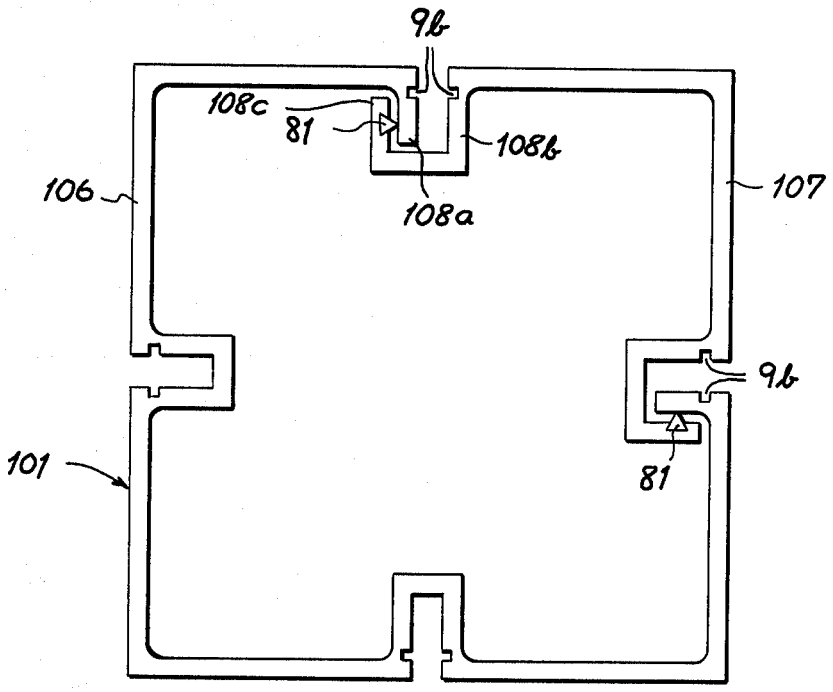
FIG. 12 and 13 are respective top views of two modified columns.
Figure 13:
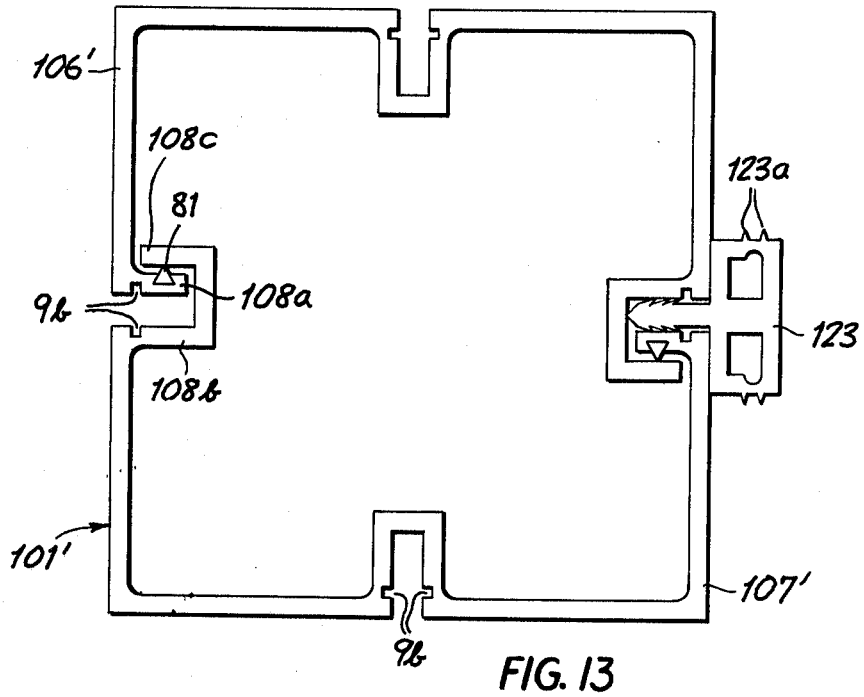

In FIGS. 12 and 13 I have shown modified corner and intermediate columns 101, 101' in which the throughgoing slots 9*b* are formed by interleaved flanges of respective shell segments 106, 107 or 106', 107'. One flange 108*a* of each pair is straight, like the flanges 8 in FIG. 1, whereas the other flange 108*b* is bent into a general J-shape and terminates in a lip 108*c* closely paralleling the flange 108*a*. A sealing strip 81 of rubber of the like, extending the full length of the slot 9*b*, lies in a recess of lip 108*c* (FIG. 12) or of flange 108*a* (FIG. 13) and, bridging the intervening gap, bears upon the confronting surface of the flange 108*a* or the lip 108*c*, respectively. Strip 81 is of generally triangular cross-section and flattens into roughly trapezoidal shape upon insertion of a mounting strip 123 into slot 9*b* as illustrated in FIG. 13.

The mounting strip, as likewise shown in FIG. 13, may be provided with outer longitudinal ribs 123*a* deformable by an adjoining wall element for sealing engagement over the full height of the latter.

The modular structure herein disclosed is particularly suitable for buildings in which the horizontal units or struts have to carry heavy loads, such as a roof or several higher stories. Thus, the architect can choose freely among the several types of available struts of various cross-sections (e.g. I, U, H or L beams) commonly in stock and need not order any custom-made profiles.

I claim:

1. A building structure assembled from prefabricated components, comprising:

a framework formed from rigidly interconnected horizontal and vertical elongate modular units defining a four-sided wall opening between them, said wall opening being bounded by confronting horizontal and vertical faces of said units, each of said faces being provided with a slot extending over the full length thereof, the slots of said faces lying in a common plane;

strips seated in said slots and projecting into said wall opening;

a four-sided wall element occupying said wall opening and resting against said strips; and retaining means on at least one of said faces for holding said wall element in position adjacent said strips;

said vertical modular units being prismatic metallic columns of substantially uniform wall thickness having inbent wall portions defining the slots thereof, said columns being split along said slots to minimize heat transfer past said strips, said inbent wall portions including a substantially straight first flange and a generally J-shaped second flange enveloping said first flange, said second flange terminating in a lip closely paralleling said first flange.

2. A structure as defined in claim 1, further comprising deformable sealing means bridging a gap between said first flange and said lip.

3. A building structure assembled from prefabricated components, comprising:

a framework formed from rigidly interconnected horizontal and vertical elongate modular units defining a four-sided wall opening between them, said wall opening being bounded by confronting horizontal and vertical faces of said units, each of said faces being provided with a slot extending over the full length thereof, the slots of said faces lying in a common plane;

strips seated in said slots and projecting into said wall opening;

a four-sided wall element occupying said wall opening and resting against said strips; and retaining means on at least one of said faces for holding said wall element in position adjacent said strips, said retaining means including a first latch member on said wall element and a coacting second latch member on one of said faces slidably engaging in the slot thereof alongside the corresponding strip.

4. A structure as defined in claim 3 wherein said first latch member is a lug fixedly carried on an edge surface of said wall element, said second latch member being a bracket provided with a flange extending into the slot of said one of said faces between a slot edge and the corresponding strip.

5. A structure as defined in claim 4 wherein said slot edge is provided with a longitudinal undercut, said flange having a bent-over lip received in said undercut.

6. A structure as defined in claim 4 wherein said lug and said bracket are of complementarily wedge-shaped configuration, said bracket having an edge bead remote from said corresponding strip for frictionally clamping said lug between the strip and said edge bead.

7. A building structure assembled from prefabricated components, comprising:

a framework formed from rigidly interconnected horizontal and vertical elongate modular units defining a four-sided wall opening between them, said wall opening being bounded by confronting horizontal and vertical faces of said units, each of said faces being provided with a slot extending over the full length thereof, the slots of said faces lying in a common plane;

strips seated in said slots and projecting into said wall opening;

a four-sided wall element occupying said wall opening and resting against said strips; and retaining means on at least one of said faces for holding said wall element in position adjacent said strips;

said vertical modular units being prismatic columns of substantially uniform wall thickness having inbent wall portions defining the slots thereof;

at least one of said horizontal modular units being a pair of spacedly juxtaposed beams having confronting faces in line with said inbent wall portions.

8. A structure as defined in claim 7 wherein said retaining means comprises a fixed stop on at least one of said faces set back from the slot thereof to accommodate said wall element between itself and the corresponding strip.

9. A building structure assembled from prefabricated components, comprising:

a framework formed from rigidly interconnected horizontal and vertical elongate modular units defining a four-sided wall opening between them, said wall opening being bounded by confronting horizontal and vertical faces of said units, each of said faces being provided with a slot extending over the full length thereof, the slots of said faces lying in a common plane;

strips seated in said slots and projecting into said wall opening;

a four-sided wall element occupying said wall opening and resting against said strips; and retaining means on at least one of said faces for holding said wall element in position adjacent said strips;

said vertical modular units being prismatic columns of substantially uniform wall thickness having inbent wall portions defining the slots thereof, said inbent wall portions including a substantially straight first flange and a generally J-shaped second flange enveloping said first flange, said second flange terminating in a lip closely paralleling said first flange.

10. A structure as defined in claim 9, further comprising deformable sealing means bridging a gap between said first flange and said lip.

11. A building structure assembled from prefabricated components, comprising:

a framework formed from rigidly interconnected horizontal and vertical elongate modular units defining a four-sided wall opening between them, said wall opening being bounded by confronting horizontal and vertical faces of said units, each of said faces being provided with a slot extending over the full length thereof, the slots of said faces lying in a common plane;

strips seated in said slots and projecting into said wall opening;

a four-sided wall element occupying said wall opening and resting against said strips; and retaining means on at least one of said faces for holding said wall element in position adjacent said strips, said retaining means including a first latch member on said wall element and a coacting second latch member on one of said faces slidably engaging in the slot thereof alongside the corresponding strip.

12. A structure as defined in claim 11 wherein said first latch member is a lug fixedly carried on an edge surface of said wall element, said second latch member being a bracket provided with a flange extending into the slot of said one of said faces between a slot edge and the corresponding strip.

13. A structure as defined in claim 12 wherein said slot edge is provided with a longitudinal undercut, said flange having a bent-over lip received in said undercut.

14. A structure as defined in claim 12 wherein said lug and said bracket are of complementary wedge-shaped configuration, said bracket having an edge bead remote from said corresponding strip for frictionally clamping said lug between the strip and said edge bead.

* * * * *